US005518335A

United States Patent [19]

Dobbins

[11] Patent Number: 5,518,335

[45] Date of Patent: May 21, 1996

[54] RADIAL BALL LOCK-UP DEVICE

[75] Inventor: David R. Dobbins, LaGrange, Ga.

[73] Assignee: Hesco, Inc., LaGrange, Ga.

[21] Appl. No.: 432,711

[22] Filed: May 2, 1995

Related U.S. Application Data

[62] Division of Ser. No. 203,033, Feb. 28, 1994, Pat. No. 5,447,092.

[51] Int. Cl.[6] ..... F16B 21/10

[52] U.S. Cl. ..... 403/328; 403/329

[58] Field of Search ..... 42/1.08, 1.09, 42/1.14, 1.15, 1.16, 16; 89/1.57, 1.58, 27.11, 162, 165, 173, 180, 182, 183, 187.02; 403/326, 327, 328, 329

[56] References Cited

U.S. PATENT DOCUMENTS

| | | | |
|---|---|---|---|
| 1,772,656 | 8/1930 | Abbott | 42/1.08 |
| 2,290,215 | 7/1942 | Stenbera | 403/328 |
| 2,435,444 | 2/1948 | Johnsen | 114/239 |
| 2,651,974 | 9/1953 | Simpson | 89/187.01 |
| 2,890,626 | 6/1959 | Amsler | 89/180 |
| 3,293,347 | 12/1966 | Wooding | 373/94 |
| 3,507,528 | 4/1970 | Desmarchais | 403/182 |
| 3,640,553 | 2/1972 | Blatt | 285/277 |
| 3,738,219 | 6/1973 | Febres | 89/187.02 |
| 3,761,117 | 9/1973 | Shendure | 285/277 |
| 3,848,510 | 11/1974 | Wolpert | 89/187.02 |
| 4,231,670 | 11/1980 | Knoski | 403/11 |
| 4,637,914 | 1/1987 | Boyle et al. | 403/194 |
| 4,770,073 | 9/1988 | Palm | 403/329 |
| 4,827,652 | 5/1989 | Martin | 42/16 |
| 4,859,110 | 8/1989 | Dommel | 403/325 |
| 4,867,039 | 9/1989 | Dobbins | 89/127 |
| 4,922,640 | 5/1990 | Toombs | 42/16 |
| 4,957,387 | 9/1990 | Nasu | 403/327 |
| 5,050,467 | 9/1991 | Brown et al. | 81/466 |
| 5,259,137 | 11/1993 | Blenk et al. | 42/16 |
| 5,416,999 | 5/1995 | Coury | 42/59 |

FOREIGN PATENT DOCUMENTS

| | | | |
|---|---|---|---|
| 11357 | 10/1956 | Germany | 89/187.02 |
| 256030 | 11/1930 | Italy | 89/173 |
| 442513 | 11/1948 | Italy | 89/180 |

OTHER PUBLICATIONS

"Bolt Actions" by Rick Jamison, *Shooting Times*, Feb. 1995 pp. 56–70.

*Primary Examiner*—Stephen C. Bentley
*Attorney, Agent, or Firm*—Birch, Stewart, Kolasch & Birch

[57] ABSTRACT

A lock-up device for a firearm which utilizes a ball and cam arrangement to interlock two members. The interlocked members include ball engagement surfaces which are curved so that a substantial portion of the ball surface is in contact with the engagement surfaces. The lock-up device disposed in a firearm absorbs recoil forces and utilizes the absorbed recoil force to cycle the firearm.

17 Claims, 11 Drawing Sheets

RADIAL BALL LOCK-UP DEVICE

This application is a divisional of application Ser. No. 08/203,033, filed on Feb. 28, 1994, now Pat. No. 5,447,092, the entire contents of which are hereby incorporated by reference.

BACKGROUND OF THE INVENTION

Field of the Invention

The present invention generally relates to a lock-up device which utilizes a ball and cam arrangement to interlock two members. The interlocked members include ball engagement surfaces which are concave so that a substantial portion of the ball surface is in contact with the engagement surfaces. More particularly, the invention relates to a firearm having a ball and cam-type lock-up mechanism to withstand high chamber pressure when the firearm is discharged and also to store inertial force from recoil which is utilized by linear reaction to unlock the mechanism and cycle ammunition, without rotational movement. It should be noted that the word firearm is being used in this application to mean any device which discharges a projectile by use of an explosive charge.

DESCRIPTION OF THE BACKGROUND ART

Prior art firearms utilize a barrel mounted gas release system operatively connected to the bolt for the release of lock-up by rotation of interlocking lugs and to move rearwardly whereby loading of ammunition may automatically-be carried out after a first round is fired. Such gas cycling methods require a complex means of connection to the bolt and require exposed locking surfaces specifically located with the bolt, which are subject to stoppage by debris, and are difficult to manufacture, especially when interchangeability of parts are required such as for organizational or departmental use. Therefore, it is desirable to have a mechanism which does not require specific location in the firearm, a gas connecting means, or rotating locking surfaces, and can be a sealed universal unit which is easily replaceable and not subject to interruption by debris, which would improve the reliability, manufacture and maintenance of the firearm.

The present invention utilizes an improved ball and cam lock-up arrangement heretofore unknown in the prior art. However, ball and cam locking devices are known for use in locking cylindrical members together.

A known locking device is disclosed in U.S. Pat. No. 3,507,528 to Desmarchais. Desmarchais '528 shows a ball-type locking device with an intermediate disengagement member. However, the ball contact surfaces contact the ball in a point engagement which results in distortion of the locking surfaces and the balls if to large a force is exerted on the locking device.

Another known locking device is disclosed in U.S. Pat. No. 3,761,117 to Shendure. The Shendure patent is also illustrative of the primary deficiencies in current ball/cam lock-ups. Namely, a lack of necessary surface contact between the ball and locking surfaces to prevent deformation under extreme loads which tends to inhibit or prohibit unlocking of the device. The Shendure device does provide a curved locking surface, but this surface is not substantially equal to that of the ball. The combination of surfaces in Shendure will only achieve essentially a point contact on the locking surface and a line contact in the frusto-conical ball retention member.

SUMMARY OF THE INVENTION

Accordingly, it is a primary objective of the present invention to provide a lock-up device which withstands extreme pressures of a discharging firearm.

It is a further objective of the present invention to provide lock ball biasing means to release the lock balls from a locking position when the locking device is cycled.

Another object of the present invention is to provide a lock-up device which is self-adjusting for varied recoil.

An additional object of the present invention is to provide a lock-up device which comprises a sealed unit which is protected form debris.

It is another objective of the present invention to provide a lock-up device which allows the use of compressive quality materials such as ceramics.

It is yet another object of the present invention to provide cycling of the mechanism, as in the feeding of ammunition in a firearm, by linear inertial guidance.

Further, it is an objective of the present invention to provide cycling of the mechanism by linear inertial guidance assisted by another available force in the device such as expanding gas in the barrel of a discharged firearm.

These and other objects of the present invention are fulfilled by providing a ball and cam lock-up device with ball contact surfaces having a radius of curvature substantially equal to the curvature of the lock balls.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
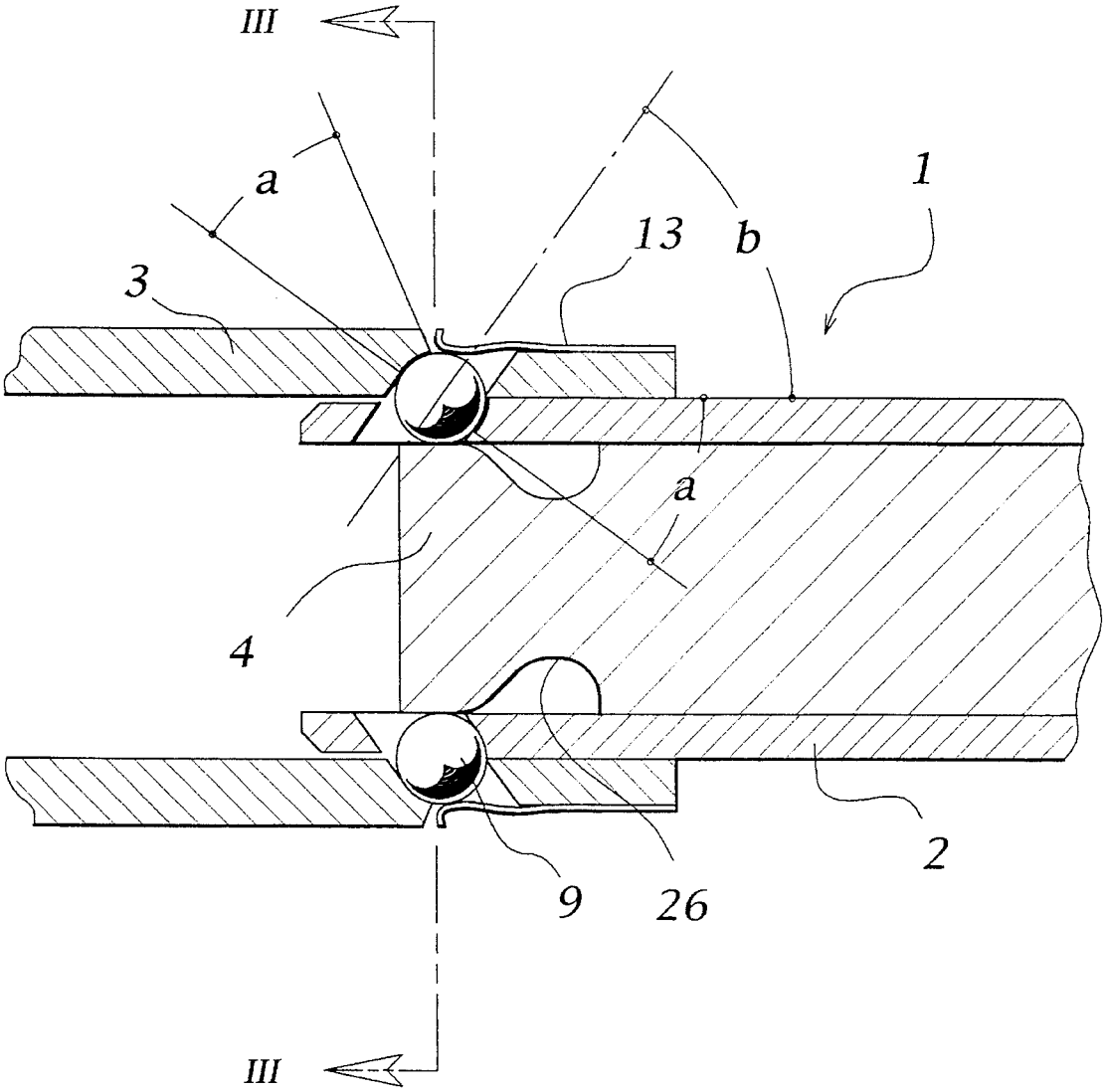
FIG. 1 is a side sectional view of a lock-up device, according to the present invention, wherein the lock balls are in a locked position.
Figure 2:
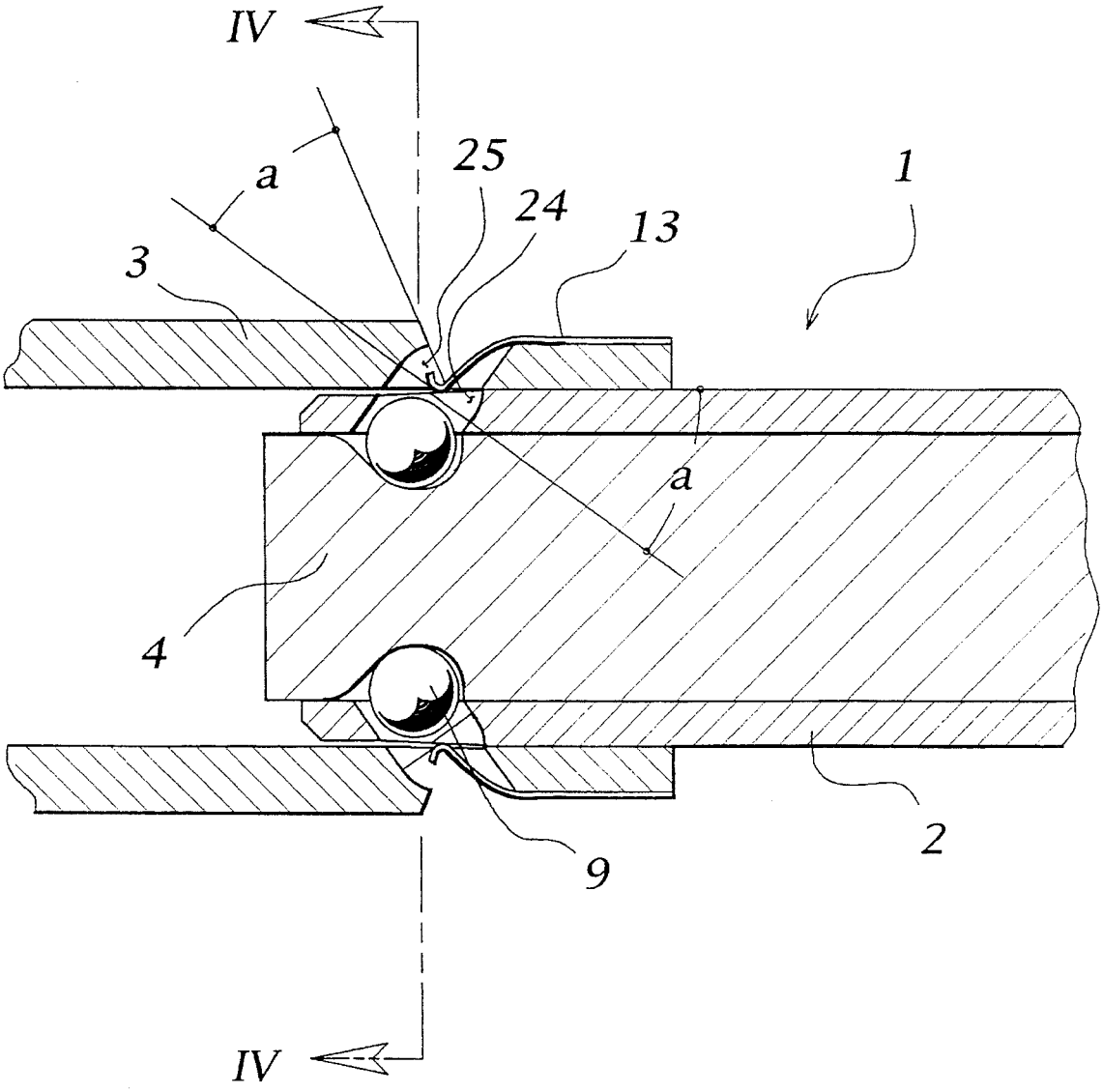
FIG. 2 is a side sectional view of the lock-up device in FIG. 1, wherein the lock balls are in an unlocked position.
Figure 3:
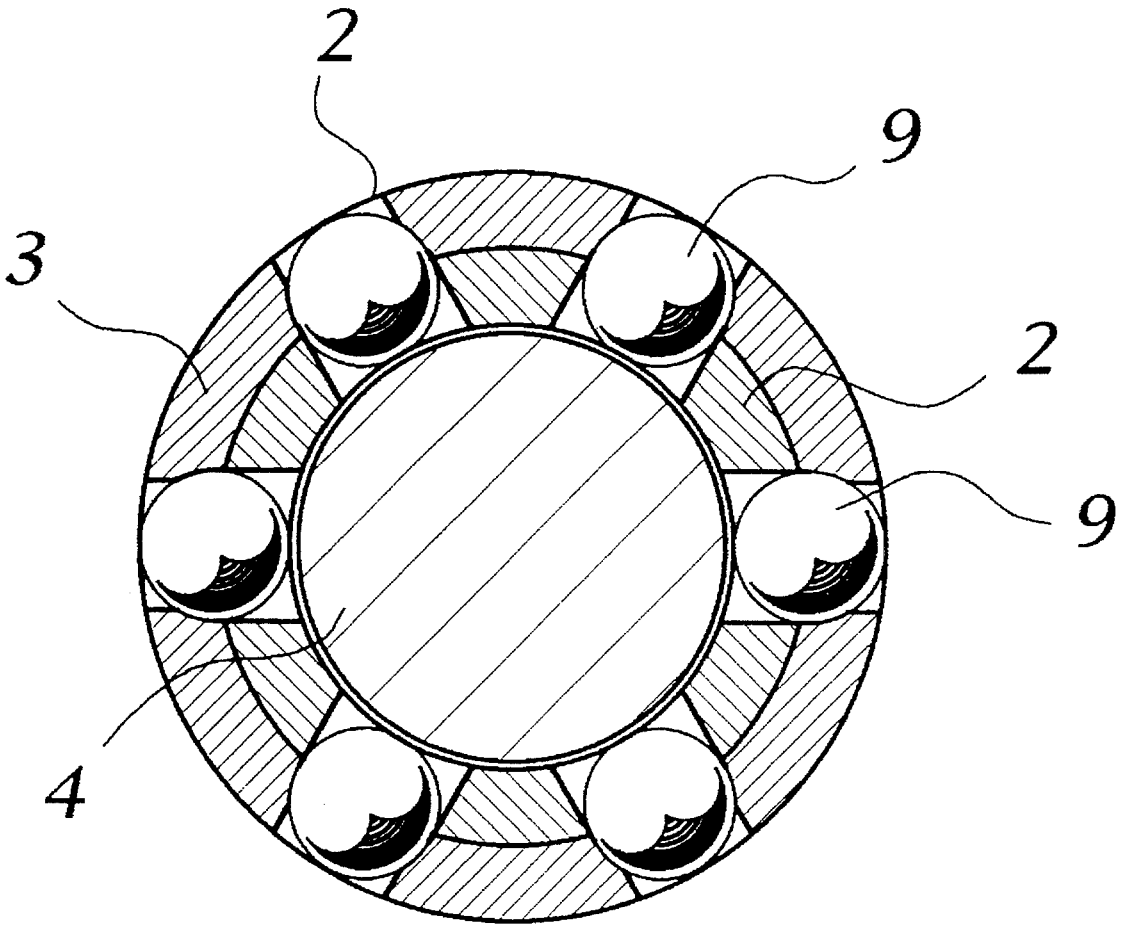
FIG. 3 is a cross sectional view along line III—III in FIG. 1.
Figure 4:
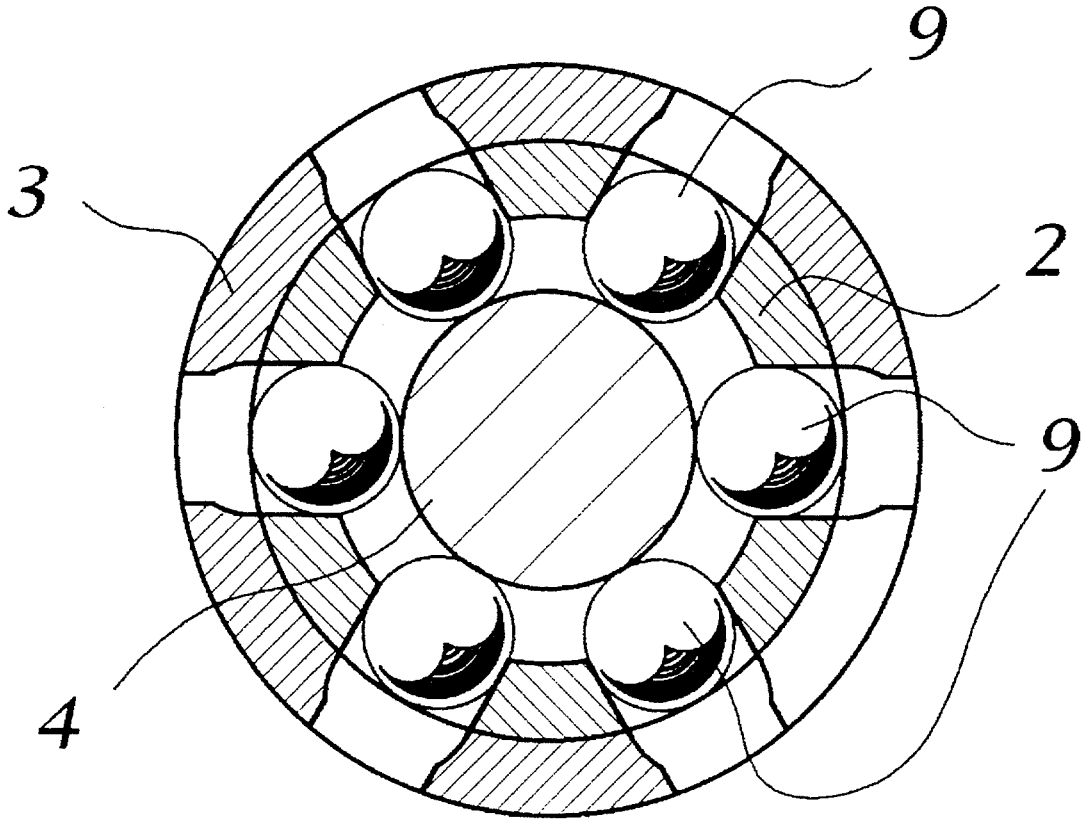
FIG. 4 is a cross sectional view along line IV—IV in FIG. 2.

Referring in detail to the drawings and with particular reference to FIGS. 1–4, a lock-up device 1 is shown for locking together a pair of sleeves. This lock-up device has an inner lock sleeve 2 slidably received within an outer lock sleeve 3. A cam member 4 is disposed within the inner lock sleeve 2. As will be shown later, the cam member 4 can be disposed on the outer surface of the outer lock sleeve 3. The cam member 4 is provided with a cam surface 26 for forcing locking balls 9 into the locking position as shown in FIGS. 1 and 3, and for receiving the locking balls 9 in an unlocking position as shown in FIGS. 2 and 4.

The inner lock sleeve 2 is provided with a ball contact surface 24. The outer lock sleeve 3 is provided with a ball contact surface 25. Several lock balls 9 are provided around the periphery of the lock-up device. The lock balls 9 are movable between the locking position and the unlocking position along ball contact surfaces 24 and 25, as shown in FIGS. 1–4. The inner and outer lock sleeve ball contact surfaces 24 and 25 are concave and have a radius of curvature substantially equal to the curvature of the lock balls 9. In other words, the inner and outer lock sleeve ball contact surfaces 24 and 25 are cupped so as to achieve maximum contact with the balls 9. Described in yet another way, the ball contact surfaces 24,25 are formed of a three dimensional section of an inner-spherical surface. The achievement of increased ball contact surface area allows the lock-up device to withstand much higher loads than conventional ball lock-up devices. The increased contact surface area distributes the load so that the lock ball and inner and outer lock sleeve contact surfaces are less likely to deform. Placement of the center of the balls in alignment with the contact surfaces between inner lock sleeve 2 and outer lock sleeve 3 also helps to avoid deformation. Through experimentation, it has been determined that an optimal surface contact area of about 34% is obtainable, as indicated by angles a in FIG. 1, while the angle b should be minimized to enhance unlocking.

The outer lock sleeve 3 is provide with leaf springs 13 for biasing the lock balls 9 from the locked position when the cam member 4 is moved to the unlocking position as shown in FIG. 2. The leaf springs 13 can be replaced with other biasing means, examples of which would be any other type spring, air pressure or a mechanical linkage movable with the cam member 4 to bias the lock balls 9 from the locking position when the cam member 3 is moved to the unlocking position.

Figure 5:
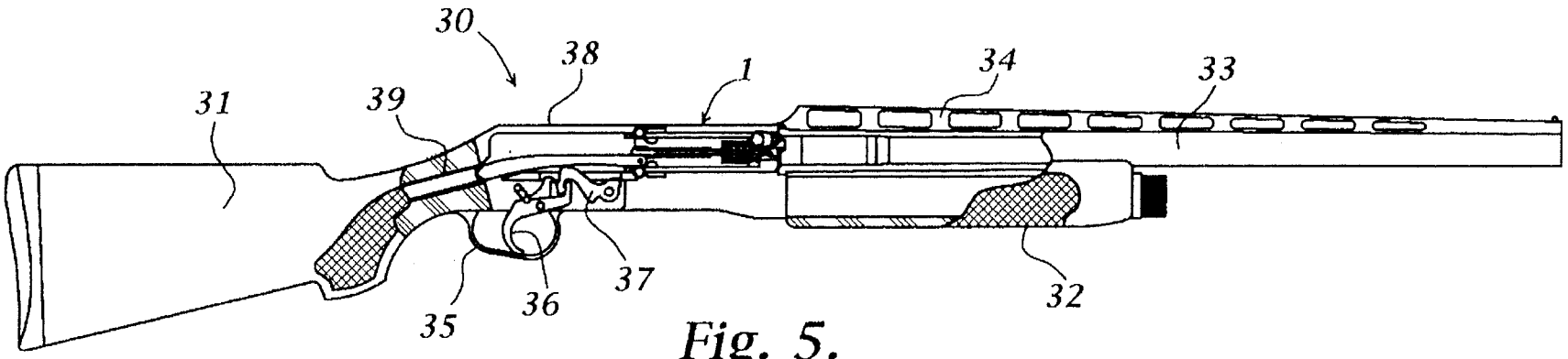
FIG. 5 is a side view of a shotgun having a lock-up device according to the present invention.

The operation of the preferred embodiment of the lock-up device will now be described with reference to FIGS. 5 and 6. In FIG. 5, a firearm 30 is shown, having a lock-up device 1. The firearm includes a buttstock 31 which is attached to a rear end of a receiver portion 38. A forestock 32 is attached at a forward end of the receiver portion 38. A barrel 33 is provided above the forestock 32 and in connection with the forward end of the receiver portion 38. A sight rib 34 is disposed along the length of the barrel 33.

A trigger guard 35 is below the receiver portion 38 and is disposed around a trigger 36. A hammer 37 is in connection with the trigger 36 and is located within the receiver portion 38. The lock-up device 1 is also disposed within the receiver portion 38.

Figure 6:
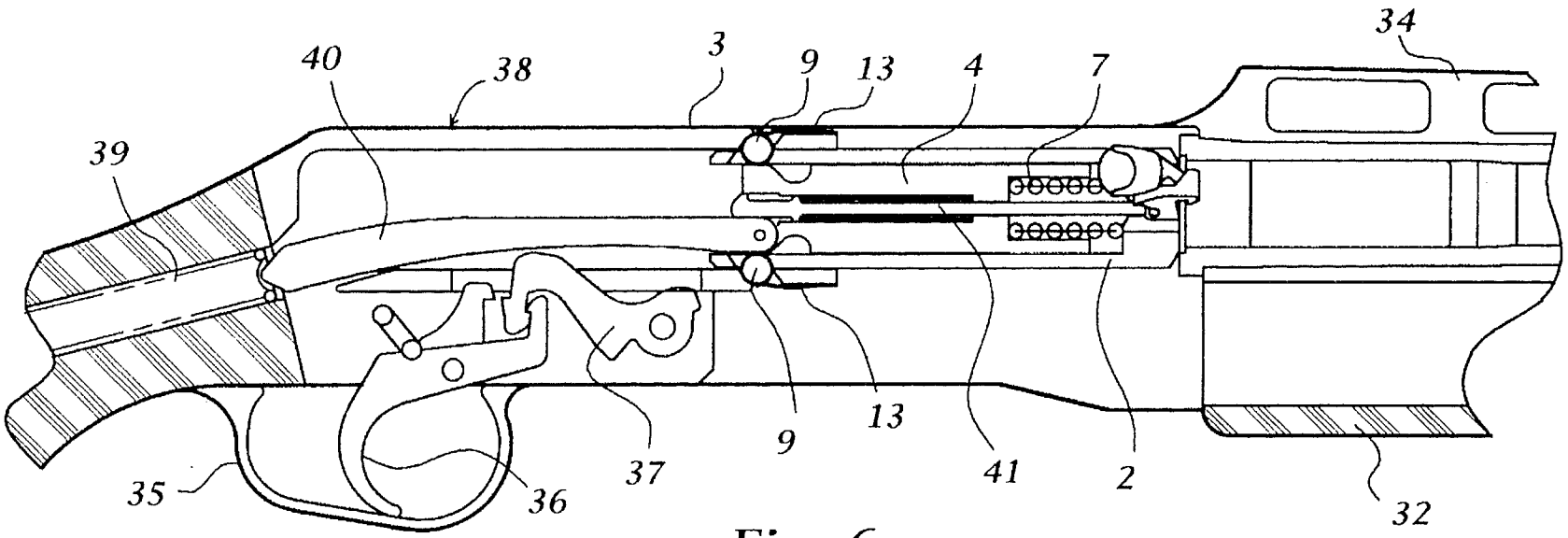
FIG. 6 is an enlarged sectional side view of the lock-up device of FIG. 5.
Figures 7A, 7B, 7C, 7D:
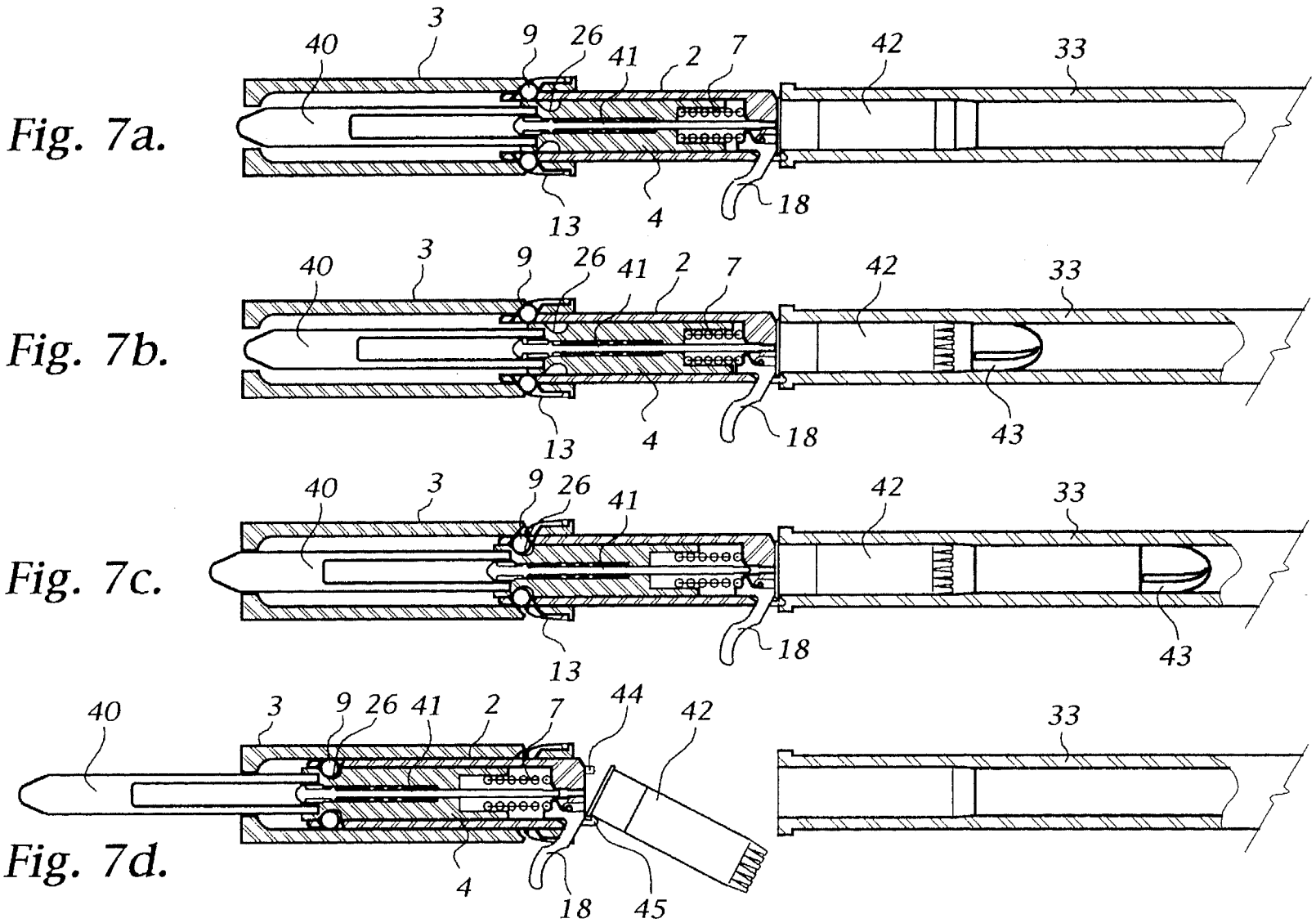
FIGS. 7*a*–7*d* illustrate each phase of operation of the lock-up device as embodied in the shotgun of FIG. 5.

Reference is now made to FIG. 6, which shows the operating components of the present invention disposed within the firearm 30. The lock-up device 1 is shown in the receiver portion 38 of the firearm. The lock-up device 1 includes inner lock sleeve 2 disposed within the outer lock sleeve 3. A cam member 4 is disposed within the inner lock sleeve 2. Lock balls 9 are disposable in a locking position, as is shown in FIG. 6, between the inner lock sleeve 2 and the outer lock sleeve 3. The lock balls 9 are also disposable in an unlocking position within the cam grooves 26, as will be shown with respect to FIGS. 7*c* and 7*d*.

A recoil rod 40 is pivotally attached on one end to the cam member 4. The other end of the recoil rod 40 is disposed so as to press against recoil spring 39 which acts to bias the recoil rod 40 against rearward movement. A firing pin 41 is disposed within the cam member 4.

The operation of the locking device within the firearm will now be discussed with reference to FIGS. 6 and 7(*a*)–7(*d*). In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33, as shown in FIG. 7(*b*). Also shown in FIG. 7(*b*), the barrel 33 and the inner lock sleeve 2, which are subject to a recoil force which is equal and opposite to the force exerted on the projectile 43, causes the barrel 33 and inner lock sleeve 2 to move rearward relative to the cam member 4. This relative movement causes the cam spring 7 to contract at first, thus storing inertia energy, as shown in FIG. 7(*b*).

With reference to FIG. 7(*c*), the cam spring 7 subsequently expands, forcing the cam member 4 to slide relative to the inner and outer lock sleeves 2 and 3, and allowing the lock balls 9 under the force of spring member 13, to disengage from the locking position. As the lock balls 9 are biased by the leaf spring 13 into the cammed groove 26, the inner lock sleeve 2 is free to move relative to the outer lock sleeve 3, as shown in FIG. 7(*d*).

In FIG. 7(*d*), the lock-up device is shown in its cycling phase. During this phase, the cam member 4 and inner lock sleeve 2 are locked together by lock balls 9. The recoil rod 40 presses against recoil spring 39, causing the recoil spring 39 to contract. When the inner lock sleeve 2 reaches a furthest rearward position, the spent ammunition cartridge 42 is ejected by the ejector and extractor members 44 and 45, respectively, through an opening in the receiver portion 38 of the firearm 30, by methods which are known. The new ammunition cartridge is then reloaded, by methods which are known, and the recoil spring 39 forces recoil rod 40 to move the cam member 4 and inner lock sleeve 2 to move forward. When the inner lock sleeve has reached its original position, the recoil spring 39 which is still under load, biases the cam 4 to move forward, thereby forcing the ball up the cam surface 26 and into the locking position between inner lock sleeve 2 and outer lock sleeve 3 as shown in FIG. 7(*a*).

It is noted that a manual cocking handle 18 is in connection with the cam member 4, so that the ammunition cartridge 42 can be inserted or removed without requiring the firearm to be discharged.

Figure 8B:
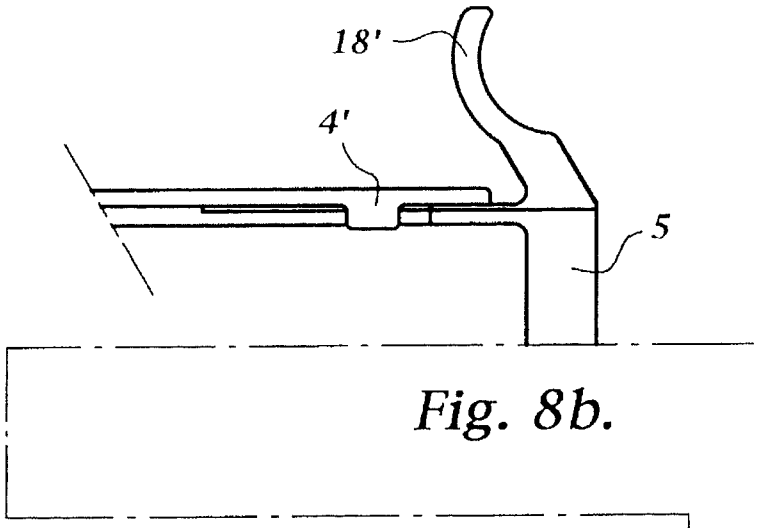
FIGS. 8*a* and 8*b* is a side view of another embodiment of the present invention with the lock-up device shown in the locked position.
Figure 8C:
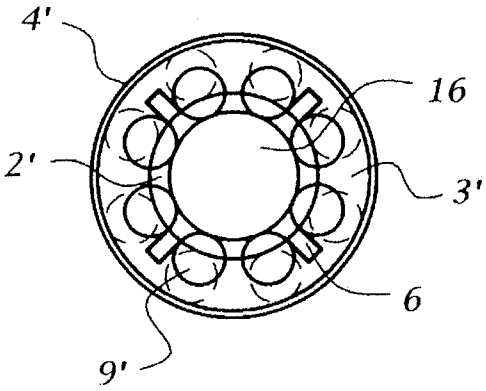
FIG. 8*c* is a cross sectional view showing the lock balls in the locked position.
Figure 8A:
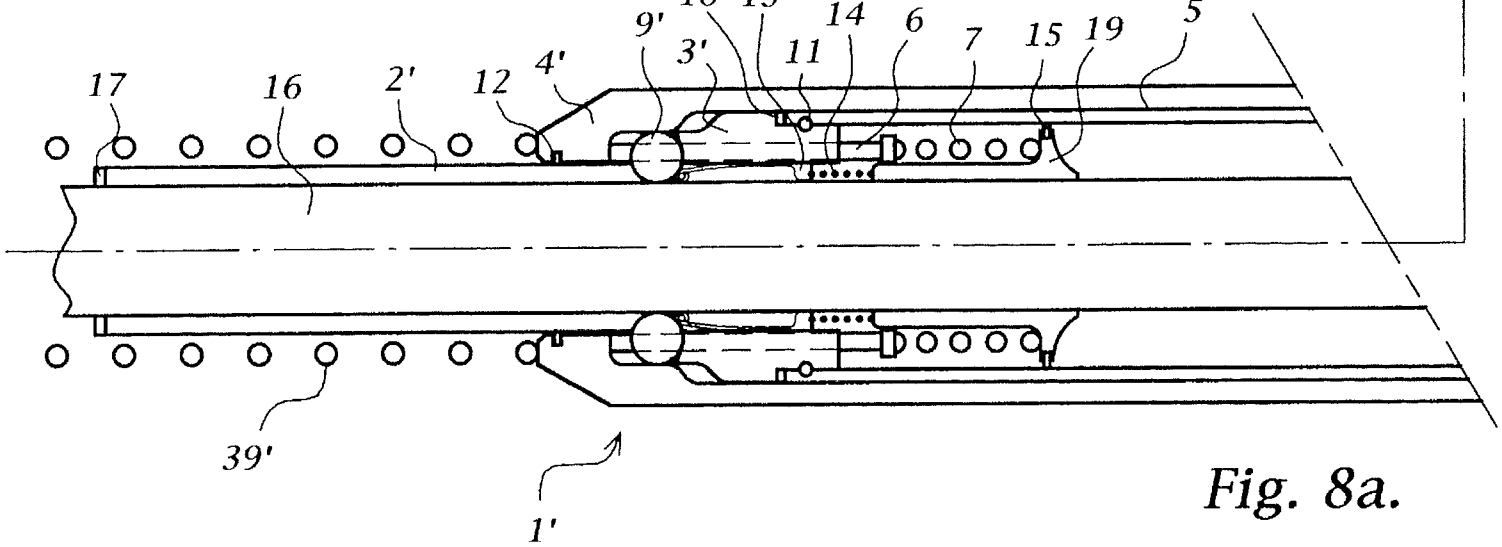

The operation of another embodiment of the present invention will now be described with reference to FIGS. 8–12. In this embodiment, the lock-up device 1' has a cam member 4' disposed radially outward of the inner lock sleeve 2'. In FIG. 8*a*, the lock-up device 1' is shown in the locked position with the inner lock sleeve 2' and the outer lock sleeve 3' locked together by lock balls 9'. The lock balls 9' are disposed between the concave ball contact surfaces 24' and 25' of inner and outer lock sleeves 2' and 3', respectively Cam member 4' is disposed radially outward of the inner and outer lock sleeves 2' and 3', and operates to maintain the lock balls 9' in the locked position.

A seal 12 is disposed between a front portion of the cam 4' and the inner lock sleeve 2'. A bolt 5 is slidably disposed radially inward of a rear portion of the cam member 4'. A bolt/outer lock sleeve retainer 11 is provided for retaining the bolt 5 and outer lock sleeve 3' in contact. A seal/headspace adjusting shim 10 is provided between a forward end of the bolt 5 and the outer lock sleeve 3' at a location radially inward of the cam member 4'.

A ball spreader 13' is located at the forward end of the inner lock sleeve 2' and is located radially inward of the outer lock sleeve 3' while the lock-up device 1' is in the locked position. The ball spreader 13' in the embodiment shown is a leaf spring, however any biasing means may be replaced for the leaf spring. A spreader spring 14 is provided between the ball spreader 13' and a spring stop member 19. A cam spring 7' and a cam spring actuator rod 6 are provided between the spring stop member 19 and the cam member 4'. The spring stop member 19 is disposed within the bolt 5 and is provided with a seal 15 between a radial portion of the spring stop member 19 and the bolt 5. The spring stop member 19 is fixed to the shaft member 16. The shaft member 16 is for example the barrel of the firearm, however, it may be a magazine tube or other shaft.

Figure 9B:
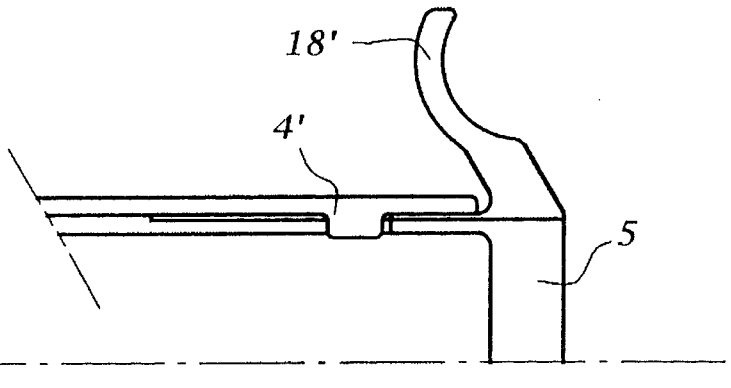
FIGS. 9*a* and 9*b* is a side view of the invention of FIGS. 8*a* and 8*b* with the lock-up device under recoil.
Figure 9C:
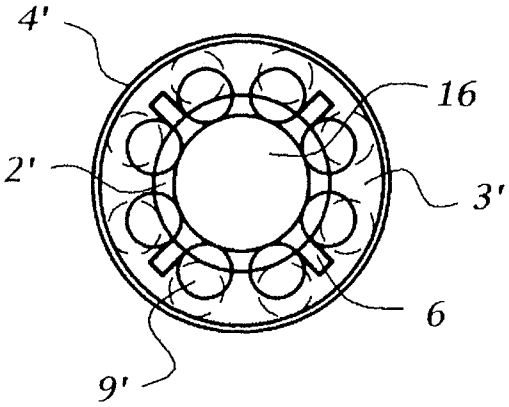
FIG. 9*c* is a cross sectional view showing the lock balls in the recoil position.
Figure 9A:
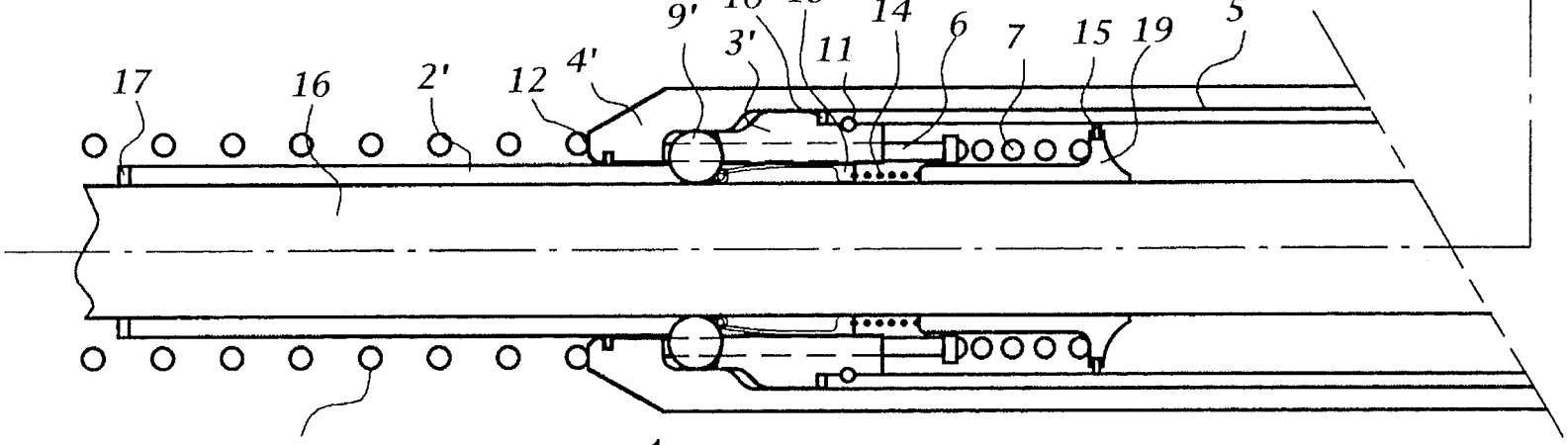
Figure 10B:
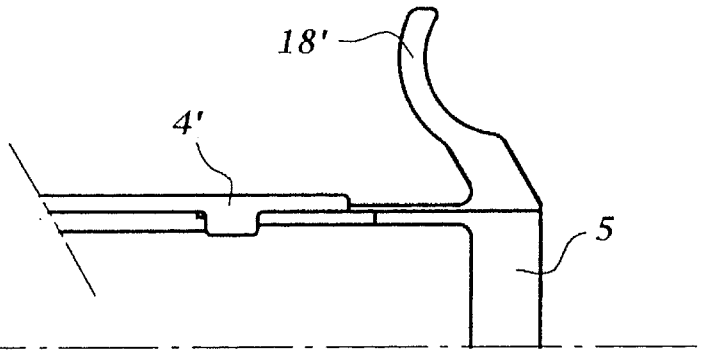
FIGS. 10*a* and 10*b* is a side view of the invention of FIGS. 8*a* and 8*b* with the lock-up device in an unlocking position.
Figure 10C:
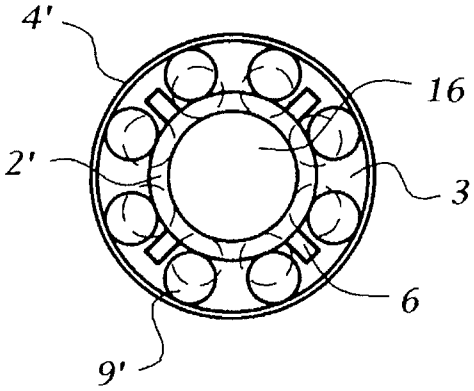
FIG. 10*c* is a cross sectional view showing the lock balls in an unlocking position.
Figure 10A:
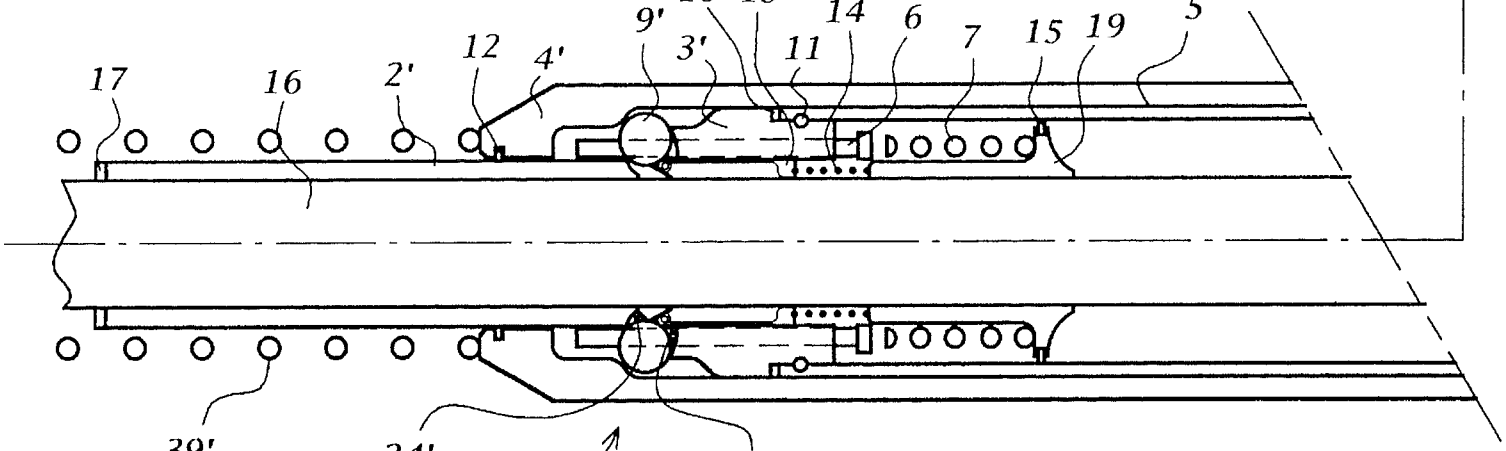
Figure 11B:
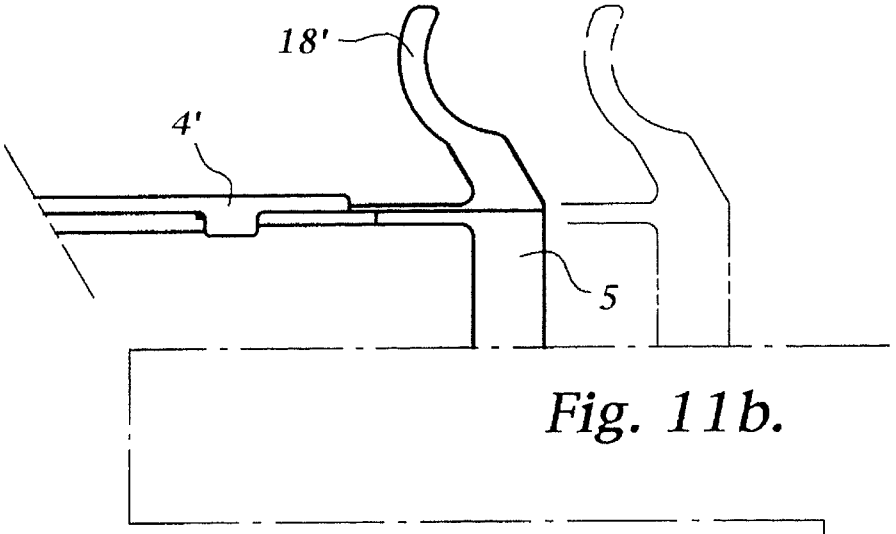
FIGS. 11*a* and 11*b* is a side view of the invention of FIGS. 8*a* and 8*b* with the lock-up device cycling.
Figure 11C:
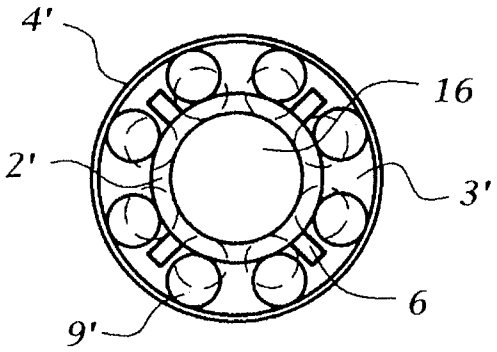
FIG. 11*c* is a cross sectional view showing the lock balls in an unlocked position.
Figure 11A:
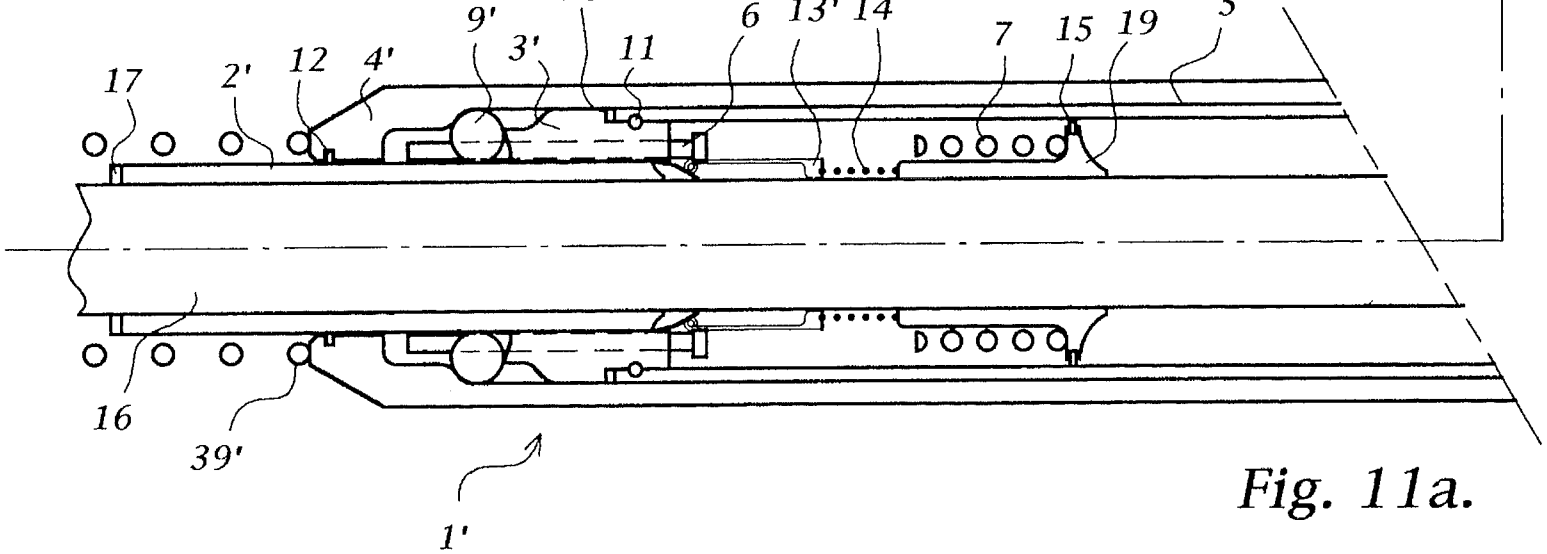

In operation, when inertia is delivered to inner lock sleeve 2', the outer lock sleeve 3' is forced rearward which in turn, delivers a rearward force to the inner lock sleeve 2' through lock balls 9'. As the outer lock sleeve 3' is forced rearward, the cam spring 7 is compressed through connection to the cam member 4' by the cam spring actuator rod 6. While the cam spring 7 is being compressed, the cam member 4' is allowed to move forward relative to the inner and outer lock sleeves 2' and 3', as shown in FIG. 9*a*. The cam spring 7 then expands, forcing the cam member 4' to move rearward relative to the inner lock sleeve 2' and outer lock sleeve 3'. As the inner lock sleeve 2' and the outer lock sleeve 3' reach the position as shown in FIG. 10*a*, the lock balls 9' are biased out of the locking position by the ball spreading means 13'. As the lock balls 9' are disengaged, the outer lock sleeve 3' is forced to move rearward relative to the inner lock sleeve 2' by the inertia force stored in the cam spring 7 which is compressed As is shown in FIG. 11*a*, the outer lock sleeve 3' has slid rearward, thereby allowing the firearm ammunition to be cycled. A recoil spring 39' biases the cam member 4' forward relative to the inner lock sleeve 2' and back into the locked position as shown in FIG. 8*a*.

Figure 12B:
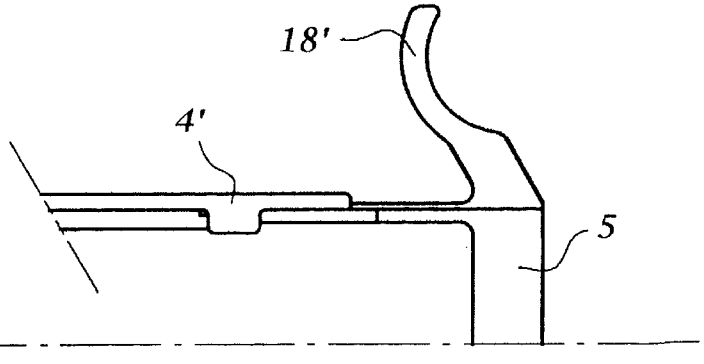
FIGS. 12*a* and 12*b* is a sectional side view of a lock-up device of the present invention disposed in a firearm with a gas assist.
Figure 12C:
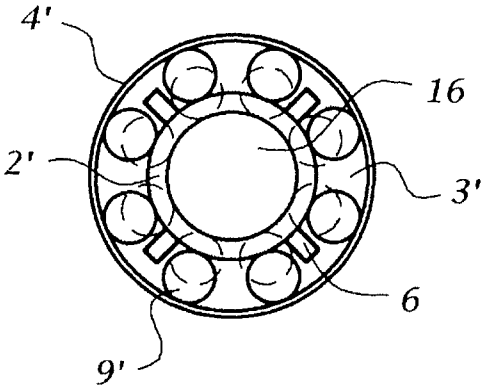
FIG. 12*c* is a cross sectional view showing the lock balls in an unlocked position.
Figure 12A:
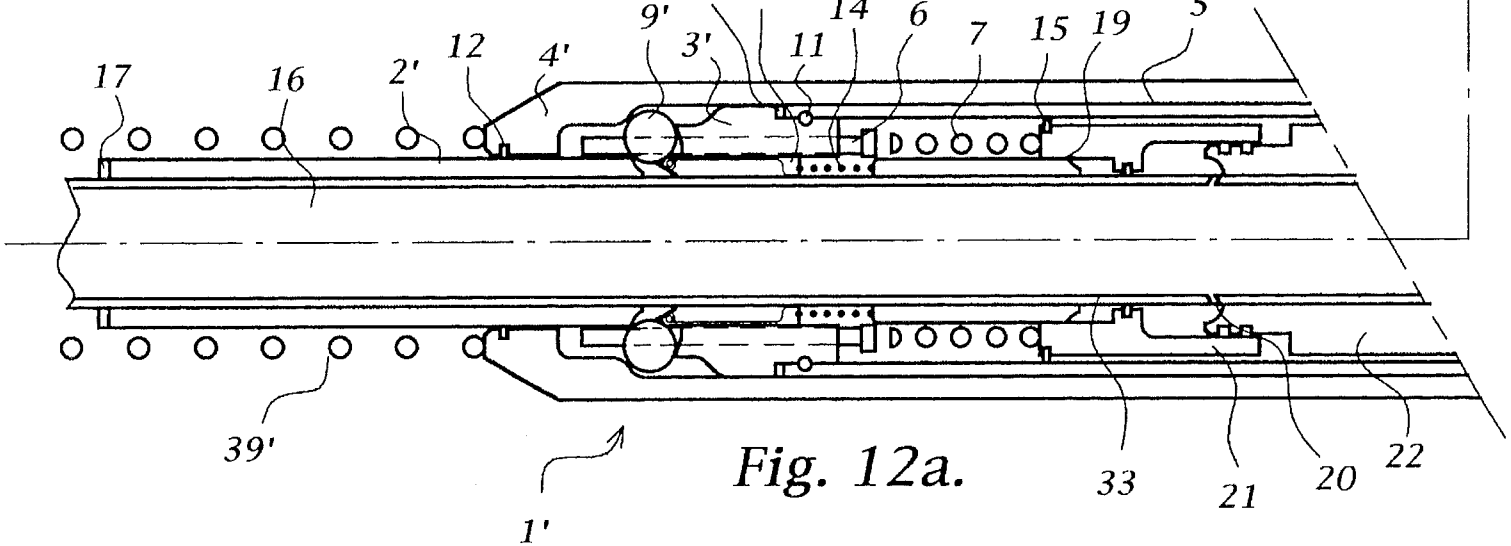

Another embodiment of the present invention is shown in FIGS. 12*a–c*. The lock-up device 1' is the same as in the previous embodiment, however a gas assist device has been added to assist the lock-up device in cycling. Where less powerful ammunition cartridges are used, it may be necessary to add the gas assisted device to insure that the firearm completely cycles.

In FIG. 12*a*, the gas assist device includes a gas port 20 on the inner surface of the barrel member 33. A gas block 22 is disposed radially outward and forward of the gas port 20. A gas piston 21 engages the gas block 22 and connects it to the cam member 4'.

In operation, when an ammunition cartridge is fired, the projectile is discharged down the barrel 33, due to the explosive force of the ammunition cartridge. Expanding gas in the barrel enters the gas port 20, thus creating a forward pressure force on gas block 22, which in turn causes the gas piston 21 to move rearward and exert a compression force on cam spring 7. In the case of smaller ammunition cartridges, the additional compression force applied to cam spring 7 is sufficient to assist the lock-up device 1' in cycling the firearm. The complete cycle of this embodiment is the same as that of the embodiment of FIGS. 8–11, therefore a complete description of the operation is unnecessary.

Having thus described the invention several of the operating features of the invention will now be described. First, the lock-up device of the present invention is self adjusting for varied recoil. In other words, if the recoil is relatively large, due to a more powerful ammunition cartridge, the lock balls 9 are retained in the lock-up position for a longer period of time while the cam spring 7 is further compressed and thus absorbs the higher inertial force.

Second, the lock-up device of the present invention comprises a sealed universal unit with the seals 10, 12 and 15 operating to protect the lock-up mechanism from debris, which has been a considerable problem in the prior art.

Third, the invention as described allows the inner lock sleeve 2, 2' and outer lock sleeve 3, 3' to be made of compressive quality materials such as ceramics. This is a significant departure from previous designs which require tensile and shear quality materials such as steel. The use of ceramics can reduce material and manufacturing costs.

Finally, the invention allows cycling of the mechanism by linear inertial guidance by use of a mechanism which is much less complex than known rotational cycling mechanisms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A radial ball lock-up mechanism, comprising:

a plurality of lock balls having a predetermined radius of curvature;

an inner lock sleeve having a plurality of concave ball contact surfaces with a curvature substantially equal to said radius of curvature of said lock balls;

an outer lock sleeve axially aligned with said inner lock sleeve and having a plurality of concave ball contact surfaces with a curvature substantially equal to said radius of curvature of said lock balls;

a cam member axially aligned with said inner lock sleeve and said outer lock sleeve, the cam member being disposed radially outward of said inner lock sleeve and said outer lock sleeve;

said plurality of lock balls are disposable in a locking position between said inner lock sleeve concave ball contact surfaces and said outer lock sleeve concave ball contact surfaces to prevent relative axial movement of said inner lock sleeve and said outer lock sleeve;

said lock balls are releasable from said locking position by relative movement of said cam member along a first axis for relative axial movement of the lock balls along second axes between said inner lock sleeve and said outer lock sleeve, the first axis being nonperpendicular to the second axes; and biasing means for biasing said lock balls from said locking position.

2. The radial ball locking mechanism of claim 1, wherein said biasing means includes a leaf spring.

3. The radial ball locking mechanism according to claim 1, wherein said inner and outer lock sleeves are made of a ceramic.

4. The radial ball locking mechanism of claim 1, wherein the concave ball contact surfaces of the inner lock sleeves are on an opposed side of the lock balls to the concave ball contact surfaces of the outer lock sleeves.

5. A radial ball lock-up mechanism, comprising:

a plurality of lock balls having a predetermined radius of curvature;

an inner lock sleeve having a plurality of concave ball contact surfaces with a curvature substantially equal to said radius of curvature of said lock balls;

an outer lock sleeve axially aligned with said inner lock sleeve and having a plurality of concave ball contact surfaces with a curvature substantially equal to said radius of curvature of said lock balls;

a cam member axially aligned with said inner lock sleeve and said outer lock sleeve, the cam member being disposed radially inward of said inner lock sleeve and said outer lock sleeve;

said plurality of lock balls are disposable in a locking position between said inner lock sleeve concave ball contact surfaces and said outer lock sleeve concave ball contact surfaces to prevent relative axial movement of said inner lock sleeve and said outer lock sleeve;

said lock balls are releasable from said locking position by relative movement of said cam member along a first axis for relative axial movement of the lock balls along second axes between said inner lock sleeve and said outer lock sleeve, the first axis being nonperpendicular to the second axes; and biasing means for biasing said lock balls from said locking position.

6. The radial ball locking mechanism of claim 5, wherein said biasing means includes a leaf spring.

7. The radial ball locking mechanism of claim 5, wherein inner and outer lock sleeves are made of a ceramic.

8. The radial ball locking mechanism of claim 5, wherein the concave ball contact surfaces of the inner lock sleeves are on an opposite side of the lock balls to the concave ball contact surfaces of the outer lock sleeves.

9. A radial ball lock-up mechanism, comprising:

a plurality of lock balls having a predetermined radius of curvature, each of the lock balls having a center;

an inner lock sleeve having a plurality of concave ball contact surfaces formed of a three-dimensional section of an inner-spherical surface with a curvature substantially equal to said radius of curvature of said lock balls;

an outer lock sleeve axially aligned with said inner lock sleeve and having a plurality of concave ball contact surfaces with a curvature substantially equal to said radius of curvature of said lock balls, the inner and outer lock sleeves contacting one another along contact surfaces thereof, the centers of the balls being aligned with the contact surfaces;

a cam member axially aligned with said inner lock sleeve and said outer lock sleeve and said outer lock sleeve;

said plurality of lock balls are disposable in a locking position between said inner lock sleeve concave ball contact surfaces and said outer lock sleeve concave ball contact surfaces to prevent relative axial movement of said inner lock sleeve and said outer lock sleeve;

said lock balls are releasable from said locking position by relative movement of said cam member for relative axial movement between said inner lock sleeve and said outer lock sleeve.

10. The radial ball locking mechanism of claim 9, further comprising biasing means for biasing said lock balls from said locking position.

11. The radial ball locking mechanism of claim 10, wherein the biasing means includes a leaf spring.

12. The radial ball locking mechanism of claim 9, wherein the plurality of concave ball contact surfaces of the outer lock sleeve are formed of a three-dimensional section of an inner-spherical surface.

13. The radial ball locking mechanism of claim 9, wherein the first and second lock sleeves are movable along a first axis and wherein the lock balls move along a second axes when released from the locking position, the first axis being nonperpendicular to the second axes.

14. The radial ball locking mechanism of claim 9, wherein the cam member is disposed radially outward of the inner lock sleeve and the outer lock sleeve.

15. The radial ball locking mechanism of claim 9, wherein the cam member is disposed radially inward of the inner lock sleeve and the outer lock sleeve.

16. The radial ball locking mechanism of claim 9, wherein the inner and outer lock sleeves are made of a ceramic.

17. The radial ball locking mechanism of claim 9, wherein the concave ball contact surfaces of the inner lock sleeves are on an opposed side of the lock balls to the concave ball contact surfaces of the outer lock sleeves.

* * * * *